US006468636B1

(12) United States Patent
Hirano

(10) Patent No.: US 6,468,636 B1
(45) Date of Patent: Oct. 22, 2002

(54) THERMAL TRANSFER RIBBON AND METHOD OF MANUFACTURING SAME

(75) Inventor: Toshifusa Hirano, Tokyo (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 68 days.

(21) Appl. No.: 09/747,728

(22) Filed: Dec. 22, 2000

(30) Foreign Application Priority Data

Dec. 27, 1999 (JP) ..... 11-369544

(51) Int. Cl.[7] ..... B41M 5/00

(52) U.S. Cl. ..... 428/195; 427/146; 427/152; 428/195; 428/488.4

(58) Field of Search ..... 427/146, 152; 428/195, 484, 913, 914

(56) References Cited

U.S. PATENT DOCUMENTS 4,812,358 A 3/1989 Miyake et al. ..... 428/323

5,362,549 A 11/1994 Imamura et al. ..... 428/195

FOREIGN PATENT DOCUMENTS

| | | |
|---|---|---|
| EP | 1060899 | 12/2000 |
| JP | 01133771 | 5/1989 |
| JP | 01198390 | 8/1989 |
| JP | 06092892 | 4/1994 |
| JP | 09106176 | 4/1997 |
| JP | 09319235 | 12/1997 |

*Primary Examiner*—Bruce H. Hess
(74) *Attorney, Agent, or Firm*—Ladas & Parry

(57) ABSTRACT

A thermal transfer ribbon comprises a substrate and a color layer formed on the substrate, the color layer comprising a binder resin and a color material, and the color material is composed of a first carbon black having a dibutyl phthalate (DBP) oil absorption of 50–150 ml/100 g and a BET specific surface area of 50–250 $m^2/g$ and a second carbon black having a DBP oil absorption of 350–500 ml/100 g and a BET specific surface area of 800–1300 $m^2/g$. The color layer contains the first and second carbon blacks at a total amount of 10–25 wt %. According to the structure described above, there can be provided a thermal transfer ribbon having a good anti-static property and capable of forming printed matters or images excellent in durability and image quality.

14 Claims, 1 Drawing Sheet

THERMAL TRANSFER RIBBON AND METHOD OF MANUFACTURING SAME

BACKGROUND OF THE INVENTION

1. Field of the Invention

The present invention relates to a thermal transfer ribbon and a method of manufacturing the same, and more particularly, to a thermal transfer ribbon having a good anti-static property and capable of forming printed letters or images excellent in anti-abrasion property and image quality.

2. Description of the Related Art

Conventionally, a fused-ink transfer system has been widely known as a printing method in which a thermal transfer ribbon is used. The thermal transfer ribbon is manufactured by forming a heat-fusible color layer onto a substrate sheet such as plastic film or the like. The heat-fusible color layer is formed by dispersing a color material such as pigment, dye or the like into a binder such as heat-fusible wax, resin or the like. In the above transfer system, an energy of an amount corresponding to image information is applied to the thermal transfer ribbon by a heating means such as thermal head or the like so that the color material together with the binder are transferred to an image-receiving sheet such as paper, plastic film or the like.

Thus printed image formed in accordance with the fused-ink transfer system has a high density and is excellent in sharpness, so that the fused-ink transfer system is suitable for recording binary images such as letter, line-drawing or the like. In addition, when a thermal transfer ribbon comprising color layers containing yellow, magenta, cyan, black dyes or the like is used and an image is printed and recorded on the image-receiving sheet so that the respective color layers are superposed, it becomes also possible to form a multi-color image or full-color image through a subtractive color process.

Such the printing method using the thermal transfer ribbon for the fusible-ink transfer system has been widely applied to various fields. For example, the image information is printed on the transfer-receiving materials such as ordinary paper (plain paper), coat paper, plastic sheet or the like by means of various thermal transfer printers such as label printer, bar-code printer, facsimile printer, word-processor printer or the like.

In view of workability at the time of replacement of the thermal transfer ribbon in the printer and in order to prevent the thermal head from being broken by dust adhesion in the printer, a requirement for a thermal transfer ribbon having anti-static function has been gradually increased in these days.

The thermal transfer ribbon providing blackish (black color) image with the carbon black easily can impart an electrical conductivity to the thermal transfer ribbon because of a grain structure of the carbon black. In general, when the carbon black is contained in one continuous layer at an amount of 30 weight % or more, the electrical conductivity can be secured in most cases. Therefore, a problem of anti-static function would be seldom raised.

Japanese Patent Laid-Open Publication No. HEI 2-63791 as a prior art discloses a thermal transfer ribbon in which Ketchen black as the electrically conductive carbon black is contained in a heat-fusible ink layer thereby to impart anti-static property to the thermal transfer ribbon.

In the embodiments disclosed in this Japanese Patent Publication No. HEI 2-63791, a thermal transfer ribbon mainly composed of wax is used. However, in a case where the color layer contains a large amount of the wax, the printed image is inferior in durability such as anti-abrasion property, alcohol resistance or the like.

On the other hand, in a case where the color layer mainly composed of thermoplastic resin as a binder structurally containing a lot of amorphous portions is provided in order to improve durability of the printed image, an apparent volume into which carbon black is dispersed will become large, and an amount of the electrically conductive carbon black required for securing the anti-static effect is disadvantageously increased. As a result, there were posed problems such that a dispersibility of carbon black is deteriorated, so that a coating liquid containing carbon black cannot be actually available. Otherwise, a stability of ink cannot be maintained for a long time, so that agglomerates of carbon black are liable to settle into the ink.

Further, according to the embodiments disclosed in the Japanese Patent Laid-Open Publication No. HEI 2-63791, a thickness of the ink layer was relatively large, so that the above prior art was not a technique capable of realizing a thin-film ribbon having a printing sensitivity enough to be applied to a high-speed type printer. In addition, in a case where a layer for improving the function of the ribbon is provided on the color layer, the above prior art was not a technique capable of sufficiently lowering a surface resistance value of the ribbon.

The other prior art, Japanese Patent Laid-Open Publication No. HEI 8-300830 discloses a thermal transfer recording medium in which a hot-melt ink layer is provided on a base material sheet and the hot-melt ink layer contains carbon black with a tinting strength index of 125 or less. The thermal transfer recording medium in this publication is good in running properties during printing and capable of obtaining a transfer image having a sufficient black degree even in low energy printing. However, this publication describes that a preferable amount of the carbon black contained in 100 parts by weight of the hot-melt ink layer is 30 parts by weight or more.

Furthermore, in a case where the color layer is formed by a coating liquid prepared by dispersing carbon black into a water-type resin, a grain structure of carbon black is easily maintained, so that the electrical conductivity of the ribbon can be easily secured. In this case, however, the binder resins in a form of emulsion particles aggregate to each other to form a discontinuous film in a micro scale. As a result, the anti-static effect is increased, but there are posed disadvantages such that the durability, in particular, a resistance to alcohol is lowered and the blocking is liable to occur under high temperature and high humidity conditions.

In recent years, there has been a strong demand for increasing sensitivity of printing media in accordance with the high-speed type printer and a demand for improving performance of the printed matter. However, the situation in these days makes it difficult to improve the performance of the thermal transfer ribbon while easily imparting the anti-static function to the ribbon.

SUMMARY OF THE INVENTION

Accordingly, the present invention has been achieved for solving the aforementioned problems, and an object of the present invention is to provide a thermal transfer ribbon having an anti-static function, being excellent in durability such as anti-abrasion property, alcohol resistance and image quality and having a good printing sensitivity.

This and other objects can be achieved according to the present invention by providing, in one aspect, a thermal transfer ribbon comprising:

a substrate; and a color layer disposed on the substrate, the color layer comprising a binder resin and a color material, wherein the color material comprises a first carbon black having a dibutyl phthalate (DBP) oil absorption of 50–150 ml/100 g and a BET specific surface area of 50–250 $m^2/g$ and a second carbon black having a DBP oil absorption of 350–500 ml/100 g and a BET specific surface area of 800–1300 $m^2/g$, and the color layer contains the first and second carbon blacks at a total amount of 10–25 wt %.

In the thermal transfer ribbon described above, it is preferable that the thermal transfer ribbon further comprises a peeling layer, and the color layer is disposed on the substrate via the peeling layer.

Further, it is also preferable that the peeling layer comprises a wax.

In addition, it is also preferable that a ratio (a:b) of a weight (a) of the first carbon black to a weight (b) of the second carbon black is set within a range of 95:5–80:20.

Furthermore, it is also preferable that the color layer is formed by a solvent coating method using a coating liquid into which the binder resin is dissolved and the color material is dispersed.

Still furthermore, it is also preferable that an ethylene-vinyl acetate copolymer containing 19–28% of a vinyl acetate component is used as the binder resin of the color layer.

In addition, it is also preferable that the thermal transfer ribbon further comprises a peeling layer comprising a micro crystalline wax or carnauba wax, and the color layer is disposed on the substrate via the peeling layer.

Furthermore, it is also preferable that an adhesive layer containing no pigment is disposed on an outermost surface of the color layer.

In another aspect of the present invention, there is also provided a method of manufacturing a thermal transfer ribbon comprising the steps of:

providing a substrate;

providing a coating liquid prepared by dissolving a binder resin and dispersing a color material into a solvent, in which the color material comprises a first carbon black having a dibutyl phthalate (DBP) oil absorption of 50–150 ml/100 g and a BET specific surface area of 50–250 $m^2/g$ and a second carbon black having a DBP oil absorption of 350–500 ml/100 g and a BET specific surface area of 800–1300 $m^2/g$, and the coating liquid contains the first and second carbon blacks at a total amount of 10–25 wt % in terms of solid content; and coating the coating liquid onto the substrate so as to form a color layer.

In the method of manufacturing the thermal transfer ribbon described above, it is preferable that the substrate is further provided with a peeling layer, and the color layer is formed on the substrate via the peeling layer. Further, it is preferable that the peeling layer comprises a micro crystalline wax or carnauba wax.

In addition, it is also preferable that a ratio (a:b) of a weight (a) of the first carbon black to a weight (b) of the second carbon black is set within a range of 95:5–80:20.

Furthermore, it is also preferable that an ethylene-vinyl acetate copolymer containing 19–28% of a vinyl acetate component is used as the binder resin.

Furthermore, it is also preferable that an adhesive layer containing no pigment is further formed on an outermost surface of the color layer.

Functions of the present invention are as follows.

The thermal transfer ribbon of the present invention has a structure comprising a substrate and a color layer containing a binder resin and color material as essential components and formed on the substrate, in which the color layer contains the color material at an amount of 10–25 wt %, and the color material comprises at least one carbon black (referred to as "first carbon blacks") having the DBP oil absorption of 50–150 ml/100 g and the BET specific surface area of 50–250 $m^2/g$ and at least one carbon black (referred to as "second carbon black") having the DBP oil absorption of 350–500 ml/100 g and the BET specific surface area of 800–1300 $m^2/g$. The first carbon black is excellent in dispersibility in solution while the second carbon black can easily form a grain structure obtainable a high electrical conductivity.

In the present invention, the above two kinds of the first and second carbon blacks are combined so as to reduce the total amount of carbon black, so that adequate anti-static property can be obtained even if the total amount of the carbon black is relatively small. As a result, there can be obtained a thermal transfer ribbon excellent in the uniformity of coated layer and the printing sensitivity or the like as well as the antistatic property.

Further, when the mixing ratio of the first and second carbon black is controlled so as to set a ratio of a weight of the first carbon black to a weight of the second carbon black within a range of 95:5–80:20, and/or when the binder resin for constituting the color layer is mainly formed of the ethylene-vinyl acetate copolymer (EVA) containing the vinyl acetate (VA) component at 19–28% and the color layer is formed by a solvent coating method using an organic solvent into which the EVA copolymer is dissolved, so that a coated layer having an improved uniformity can be obtained. As a result, there can be obtained a thermal transfer ribbon being excellent in the anti-static property, the durability such as the anti-abrasion property, the alcohol resistance and the like and having a good printing sensitivity, and being capable of forming an image with high quality.

As described above, in the thermal transfer ribbon of the present invention, two kinds of the first carbon black excellent in dispersibility in a solution and the second carbon black having a high electrical conductivity are combined, so that a sufficient anti-static property can be imparted to the ribbon even if the total amount of the carbon black contained in the color layer is small. Accordingly, the dispersibility of the carbon black in the coating liquid for color layer is not lowered, so that there can be provided a thermal transfer ribbon being excellent in the uniformity, the anti-abrasion property, the printing sensibility and being applicable to a high-speed printing type thermal transfer printer.

BRIEF DESCRIPTION OF THE DRAWING

Other objects and aspects of the present invention will become more apparent from the following description of embodiments with reference to the accompanying drawing in which:

A single drawing of FIG. 1 is a cross sectional view schematically showing one embodiment of a thermal transfer ribbon according to the present invention.

DESCRIPTION OF THE PREFERRED EMBODIMENTS

Figure 1:
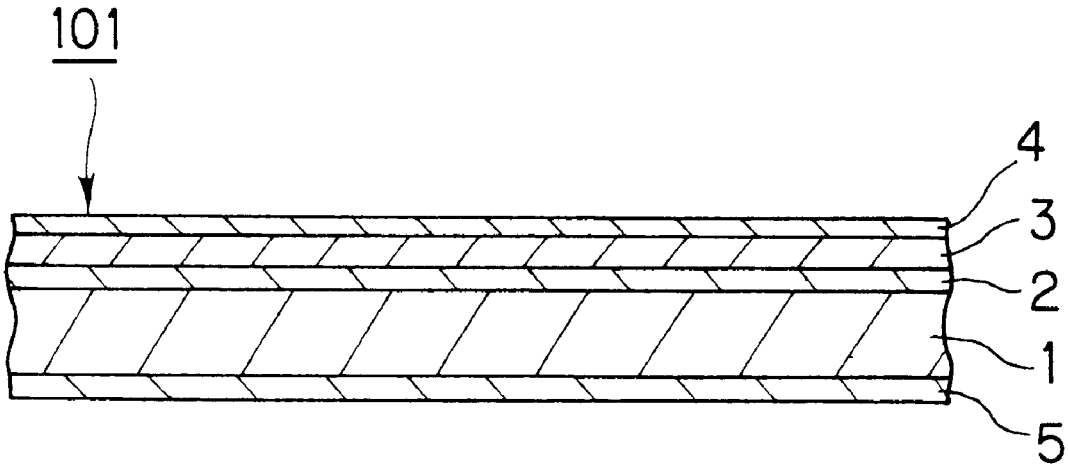

Preferred embodiments of the present invention will be explained hereunder.

The thermal transfer ribbon 101 according to the present invention has a construction in which a color layer comprising a binder resin and a color material, which are essential components, is provided on a substrate. FIG. 1 is a cross sectional view schematically showing one embodiment of a thermal transfer ribbon according to the present invention. In the thermal transfer ribbon of FIG. 1, a peeling layer 2, a color layer 3 and an adhesive layer 4 are provided in this order on one surface of a substrate 1 while a heat-resistant layer 5 is provided on the other surface of the substrate 1.

(Substrate)

In the present invention, although, as the substrate to be used in the present invention, the same substrates as those used in a conventional thermal transfer ribbon are usable as they are, the present invention is not limited thereto and the other substrates may be also used.

Concretely, preferable examples of the substrates may include, for example, plastic film such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber, ionomer or the like; papers such as condenser paper, paraffin paper or the like, non-woven fabric or the like. A composite substrate formed by laminating these materials can be also used. Further, the polyethylene terephthalate film is a particularly preferable substrate. A thickness of the substrate can be appropriately set in accordance with the material so as to give suitable strength and thermal conductivity. The thickness is preferably set to, for example, 2–25 $\mu$m in many cases.

(Peeling Layer)

It is preferable to form the color layer on the substrate via the peeling layer. The peeling layer is fused through the thermal transfer operation to thereby improve peeling property of the color layer, and at least part of the peeling layer is transferred together with the color layer and positioned on a surface of a transferred image. The transferred peeling layer becomes a protecting layer for protecting the color layer, particularly, exhibits a function of improving the anti-abrasion property of the transferred image by imparting a good slipping property to the transferred image.

As material for constituting the peeling layer, various resins such as acrylic resin, silicone resin, fluorine resin, silicone-modified resin, fluorine-modified resin or the like can be used. However, a preferable material is wax.

As the wax, it is preferable to use various waxes exhibiting a peeling property when the wax is fused at the printing operation. Examples of the wax to be preferably used may include, for example, micro crystalline wax, carnauba wax, paraffin wax, Fischer-Tropschwax, various low molecular weight polyethylene, wood wax, bees wax, spermaceti wax, insect wax, wool wax, shellac wax, candelilla wax, petrolatum, partially-modified wax, fatty acid ester, fatty acid amide, or the like. Particularly preferred waxes are micro crystalline wax and carnauba wax or the like that have a relatively high melting point and are hardly dissolved into a solvent.

The peeling layer is mainly composed of the above wax. For the purpose of improving an adhesion property of the peeling layer with respect to the substrate and improving a resolution of the printed image, thermoplastic resin, inorganic fillers such as talc, silica, kaolin or the like, organic fillers such as polystyrene-type filler and acrylic-type filler, and various additives can be added to the peeling layer, as far as the range of the addition amount of the additives do not obstruct a transferring property. In this connection, the content of the wax-material to be contained in the peeling layer is preferably set to 50 wt % or more, and particularly set to 80 wt % or more.

The above peeling layer is preferably formed as a thin layer so as not to lower the sensitivity of the thermal transfer ribbon. The peeling layer can be formed by, for example, hot-melt coating method, solvent-coating method, emulsion coating method or the like so as to have a thickness of about 0.1–2 g/m$^2$ (in a dried state).

(Color Layer)

The color layer is mainly composed of the binder resin and the color material, and a content of the color material contained in the color layer is 10–25 wt %. The color layer contains two types of carbon black, that is, one is the first carbon black having a DBP (dibutyl phthalate) oil absorption of 50–150 ml/100 g and BET specific surface area of 50–250 m$^2$/g, and the other is the second carbon black having a DBP oil absorption of 350–500 ml/100 g and the BET specific surface area of 800–1300 m$^2$/g.

The above first carbon black has a relatively excellent dispersibility in a coating liquid, but it has less exhibition of an electrical conductivity. In contrast, though the second carbon black can easily form a grain structure and then exhibits a high electrical conductivity, but the second carbon black is inferior in dispersibility in the coating liquid.

Accordingly, in the present invention, the above two kinds of the first and second carbon black are mixed within an appropriate mixing-range and used. It is preferable that a ratio of weight of the first carbon black to weight of the second carbon black is set within a range of 95:5–80:20.

When the amount of the second carbon black is less than the above range, it becomes difficult to impart the electrical conductivity to the color layer. On the other hand, when the amount of the second carbon black exceeds the above range, the dispersibility in the coating liquid is disadvantageously lowered.

In addition, when the DBP oil absorption of the first carbon black is less than 50 ml/100 g, the electrical conductivity of the color layer is deteriorated. Assuming that the electrical conductivity is imparted to the color layer by using the carbon black having a small DBP oil absorption, there is no other way but to increase the total amount of the carbon black to be added to the color layer, or to increase the amount of the second carbon black. As a result, the printing sensitivity of the thermal transfer ribbon is lowered, and dispersibility of the coating liquid for color layer is lowered. On the other hand, when the DBP oil absorption of the first carbon black exceeds 150 ml/100 g, the dispersibility of the coating liquid for color layer is lowered.

Furthermore, when the BET specific surface area of the first carbon black is less than 50 m$^2$/g, a color density is not enough and, thus, it cannot be adapted practical use. Furthermore, when the BET specific surface area of the first carbon black exceeds 250 m$^2$/g, the dispersibility of the coating liquid for color layer is lowered.

When the DBP oil absorption of the second carbon black is less than 350 ml/100 g or when the BET specific surface area of the second carbon black is less than 800 m$^2$/g, the electrical conductivity is not sufficiently imparted to the color layer. Further, when the DBP oil absorption of the second carbon black exceeds 500 ml/100 g or when the BET specific surface area of the second carbon black exceeds 1300 m$^2$/g, the dispersibility of the coating liquid for the color layer is lowered.

As described above, the first and second carbon blacks are combined to limit the total amount thereof in the color layer to a range of 10–25 wt %. As a result, even if the total amount of the color material in the color layer is lowered, sufficient electrical conductivity and coloring density can be imparted. In addition, since the amount of the color material is small, there can be provided a thermal transfer ribbon having a higher sensitivity.

The DBP (dibutyl phthalate) oil absorption specified in the present invention is a value to be measured in accordance with oil absorption measuring A-method prescribed in JIS (Japanese Industrial Standard) K6221. Further, the BET specific surface area prescribed by Bounower, Emett and Teller is an absorption amount of gas to be absorbed to the surface of a pigment at a constant temperature.

As the binder resin for forming the color layer, various thermoplastic resins are usable. Particularly, ethylene-vinyl acetate copolymer (EVA resin) is preferable because it can provide an excellent dispersibility of carbon black and anti-abrasion property of the printed matter.

In addition, it is particularly preferable that ethylene-vinyl acetate copolymer containing 19%–28% of vinyl acetate (VA) component is used as the binder resin. When the VA component in the molecule of the ethylene-vinyl acetate copolymer is less than 19%, an amount of functional group capable of imparting adhesive property is small, so that an adhesive strength to the transfer-receiving material is liable to be lowered. In contrast, when the VA component exceeds 28%, the electrical conductivity can be hardly imparted to the color layer. This reason will be considered that when the VA component contained in an ethylene-vinyl acetate copolymer exceeds 28%, an amorphous portion of the resin is increased.

The color layer to be formed on the substrate via the peeling layer or without interposing the peeling layer can be formed from a coating liquid to which the ethylene-vinyl acetate copolymer as the binder resin, other binder resins if necessary, color material, various additives such as dispersant, filler or the like are added as required.

As the binder resin other than the ethylene-vinyl acetate copolymer, various resins such as petroleum resin, styrene-base resin, terpene-base resin, rosin-base resin or the like will be usable and added to the coating liquid, as far as a transferring property is not obstructed. Due to the addition of such resins, the durability of the printed matter and a flowability of the coating liquid can be improved. In addition, for the purpose of improving a sharpness of the printed matter or extending an applicable range of printing papers, various waxes can also be added to the coating liquid.

Furthermore, as the pigment other than the carbon black, inorganic fillers such as silica, calcium carbonate, clay or the like, organic fillers such as polyethylene beads, styrene beads, acryl beads or the like may be appropriately used for the purpose of preventing a blocking of the thermal transfer ribbon and preventing a sticking to printing paper.

The coating liquid for color layer is preferably prepared by using a solvent capable of dissolving the binder resin. That is, the color layer is preferably formed in accordance with, so-called, a solvent-coating method in which the binder resin is dissolved into the solvent, then carbon black as the color material and pigment other than the carbon black are dispersed in the solvent to prepare a coating liquid for color layer, and the coating liquid is coated on the substrate to thereby form the color layer.

According to the color layer formed by the above solvent coating method, the binder resin is uniformly formed so as to form a continuous film, and the carbon black as the color material is dispersed in the continuous film to thereby provide the color layer excellent in the durability.

In contrast, when the color layer is formed in accordance with, so-called, an emulsion coating method using a water-base coating liquid in which the binder resin is dispersed as emulsion particles, anti-static effect is increased. However, the binder resins in a form of emulsion particles aggregate to each other to form a discontinuous film in a micro scale. As a result, the anti-static effect is increased, but there are posed disadvantages such that the durability, in particular, a resistance to alcohol is lowered and the blocking is liable to occur in high temperature and high humidity conditions.

A thickness of the color layer is usually set within a range of 0.5 $g/m^2$–3.0 $g/m^2$ in terms of coated amount in the dried state. When the thickness of the color layer is less than 0.5 $g/m^2$, a sufficient coloring property cannot be obtained. While, when the thickness of the color layer exceeds 3.0 $g/m^2$, a transferring sensitivity of an image is lowered, thus being not preferable.

In the present invention, it is preferable that the coating liquid is coated by the solvent coating method so as to form a color layer in a form of a continuous film, whereby irregularities to be formed on the coated surface of the color layer are reduced, making the coated surface smooth. As a result, the anti-abrasion property of the printed matter can be improved.

(Adhesive Layer)

In the thermal transfer ribbon of the present invention, an adhesive layer can be provided on the color layer.

The adhesive layer can improve a transferring property with respect to papers having a low surface smoothness. In addition, when the adhesive layer is formed to be substantially transparent with no color by containing no pigment, it becomes possible to prevent a surface stain of the transfer-receiving material, the surface stain being caused by rubbing the transfer-receiving material with the thermal transfer ribbon at a time of carrying operation in the printing process.

The above adhesive layer is mainly composed of thermoplastic resin capable of exhibiting an adhesive property when the adhesive layer is heated and softened by means of thermal head, laser or the like. In addition, for the purpose of preventing the blocking when the thus obtained thermal transfer ribbon is wound up into a rolled-form, various anti-blocking agents such as wax, amide, ester, salt of higher fatty acid, fluororesin, filler of inorganic substance or the like can be added to the adhesive layer.

Examples of the thermoplastic resins include, for example, ethylene-vinyl acetate copolymer (EVA), ethylene-acrylic acid ester copolymer (EEA), polyester resin, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, polyvinyl formal, polyvinyl butyral, acetyl cellulose, nitrocellulose, polyvinyl acetate, polyisobutylene, ethyl cellulose, polyacetal or the like. In particular, it is preferable to use thermoplastic resin having a relatively low softening point of, for example, 50–150 ° C. which has been conventionally used as a heat-sensitive adhesive agent.

The adhesive layer is formed by using the coating liquid, which can be prepared by dissolving or dispersing the thermoplastic resin and additives into an appropriate solvent or water. The coating liquid is coated in accordance with conventionally known methods such as hot-lacquer method, gravure-direct coating method, gravure-reverse coating method, knife-coating method, air-coating method, roll-coating method or the like so as to provide an adhesive layer at a coated amount of 0.05–5 $g/m^2$ (dried state).

When the amount of the dried coated film is less than 0.05 $g/m^2$, an adhesion property between the image-receiving sheet and the color layer is deteriorated, and transferring defective will cause at the printing operation. In contrast, when the amount of the dried coated film exceeds 5 g/m$^2$, a transferring sensitivity at the printing operation is lowered, and a sufficient image quality cannot be obtained.

(Heat-resistant Layer)

In addition, in the present invention, when a material having a small heat-resistant is used as the substrate, it is preferable to provide a heat-resistant layer on a rear surface of the thermal transfer ribbon at which a thermal head is contacted for the purpose of improving a slipping property of the thermal head and preventing the sticking phenomena. The heat-resistant layer contains, as basic components, a resin having a heat-resisting property and a material functioning as a heat thermally releasing agent or lubricant.

When such heat-resistant layer is formed, even if the thermal transfer ribbon is formed by using a plastic film having a small heat-resistance as the substrate, it becomes possible to perform the thermal-printing without causing the sticking, and the plastic film having properties of being hardly cut and easiness of being worked can be advantageously utilized.

Such heat-resistant layer can be formed by appropriately using a material which is prepared by adding slipping agent, surfactant, inorganic particles, organic particles, pigment or the like to a binder resin.

Examples of the binder resin for forming the heat-resistant layer may include: for example, cellulose resins such as ethyl cellulose, hydroxy ethyl cellulose, hydroxy propyl cellulose, methyl cellulose, cellulose acetate, cellulose acetate butyrate, nitrocellulose or the like; vinyl-type resins such as polyvinyl alcohol, polyvinyl acetate, polyvinyl butyral, polyvinyl acetal, polyvinyl pyrrolidone, acrylic resin, polyacrylamide, acrylonitrile-styrene copolymer or the like; polyester resin; polyurethane resin; silicone-modified urethane resin or fluorine-modified urethane resin or the like.

Among these binder resins, it is preferable to use a cross-linked resin which is prepared by using a resin having several functional groups such as hydroxyl group and using a cross-linking agent such as polyisocyanate together with the resin.

The heat-resistant layer is formed in such manner that a material in which slipping agent, surfactant, inorganic particles, organic particles, pigment or the like are blended in a binder resin is prepared or provided, a coating liquid is prepared by dissolving or dispersing the material into an appropriate solvent, the coating liquid is coated by means of an ordinary coating means such as gravure coater, roll coater, wire bar coater or the like to form a coated film; and then the coated film is dried to form the heat-resistant layer.

EXAMPLE

The above embodiment of the present invention will be explained more in concrete hereunder with reference to the following Examples and Comparative Examples. Further, it is to be noted that, in the Examples and Comparative Examples, "part(s)" and "%" mean "part(s) by weight" and "% by weight", respectively, unless otherwise noted specifically.

Example 1

Onto one surface of a polyethylene terephthalate film (Lumiror, available from Toray Industries, Inc.) as a substrate having a thickness of 4.5 $\mu$m, a coating liquid for forming a peeling layer having the following composition was applied by the gravure coating method in an amount of 0.7 g/m$^2$ (dried state), followed by drying to thereby form a peeling layer.

Thereafter, while a temperature of a coating liquid 1 for a color layer having the following composition was maintained to 35° C., the coating liquid 1 was applied onto the peeling layer by the gravure coating method in an amount of 1.2 g/m$^2$ (dried state), followed by drying to thereby form a color layer. As a result, a thermal transfer ribbon of Example 1 was obtained. In this connection, the coating liquid for the heat-resistant layer was applied, in advance, to the other surface of the substrate by the gravure coating method in an amount of 0.1 g/m$^2$ (dried state), followed by drying, thereby to form a heat-resistant layer.

<Coating Liquid for Peeling Layer>

- Carnauba wax emulsion (WE95, solid content 40%, available from Konishi Co., Ltd.): 95 parts
- Styrene-butadiene copolymer emulsion (LX430, solid content 50%, available from Nippon Zeon Co., Ltd.): 5 parts <Coating Liquid 1 for Color Layer>

- Carbon black #44 (DBP oil absorption 78, BET specific surface area 115, available from Mitsubishi Kagaku Co., Ltd.): 18 parts
- Ketchen Black EC600JD (DBP oil absorption 495, BET specific surface area 1270, available from Ketchen Black Industries, Inc): 2 parts
- Ethylene-vinyl acetate copolymer #250 (VA=19%, MI=15, available from Mitsui-Du Pont Polychemical Industries, Inc.): 50 parts
- Candelilla wax: 20 parts
- Petroleum resin (Neo-polymer 160, available from Nihon Sekiyu Kagaku Co., Ltd.): 10 parts
- Toluene: 285 parts
- Methyl ethyl ketone: 15 parts <Coating Liquid for Heat-resistant Layer>

- Silicone acryl copolymer (Simack US350, available from Toa Gosei Kagaku Co., Ltd.): 20 parts
- Toluene: 50 parts
- Methyl ethyl ketone: 50 parts

Example 2

The procedure for obtaining the thermal transfer ribbon of Example 1 was repeated except that a coating liquid 1 for a color layer was changed to a coating liquid 2 for a color layer having the following composition, thereby to prepare a thermal transfer ribbon of Example 2.

<Coating Liquid 2 for Color Layer>

- Carbon black #30 (DBP oil absorption 113, BET specific surface area 115, available from Mitsubishi Kagaku Co., Ltd.): 18 parts
- Ketchen Black EC (DBP oil absorption 360, BET specific surface area 800, available from Ketchen Black Industries, Inc.): 2 parts
- Ethylene-vinyl acetate copolymer #250 (VA=19%, MI=15, available from Mitsui-Du Pont Polychemical Industries, Inc.): 50 parts
- Candelilla wax: 20 parts
- Petroleum resin (Neo-polymer 160, available from Nihon Sekiyu Kagaku Co., Ltd.): 10 parts
- Toluene: 285 parts
- Methyl ethyl ketone: 15 parts

Example 3

The procedure for obtaining the thermal transfer ribbon of Example 1 was repeated except that a coating liquid for an adhesive layer having the following composition was applied onto the color layer by the gravure coating method in an amount of 0.7 g/m$^2$ (dried state), followed by drying, thereby to form an adhesive layer. As a result, a thermal transfer ribbon of Example 3 was prepared.

<Coating Liquid for Adhesive Layer>

Carnauba wax emulsion (solid content 40%): 30 parts

Ethylene-vinyl acetate copolymer emulsion (solid content 40%): 40 parts

Comparative Example 1

The procedure for obtaining the thermal transfer ribbon of Example 1 was repeated except that a coating liquid 1 for a color layer was changed to a coating liquid 3 for a color layer having the following composition, thereby to prepare a thermal transfer ribbon of Comparative Example 1.

<Coating Liquid 3 for Color Layer>

Carbon black #44 (DBP oil absorption 78, BET specific surface area 115, available from Mitsubishi Kagaku Co., Ltd.): 20 parts Ethylene-vinyl acetate copolymer #250 (VA=19%, MI=15, available from Mitsui-Du Pont Polychemical Industries, Inc.):50 parts Candelilla wax: 20 parts Petroleum resin (Neo-polymer 160, available from Nihon Sekiyu Kagaku Co., Ltd.): 10 parts Toluene: 285 parts Methyl ethyl ketone: 15 parts Comparative Example 2

The procedure for obtaining the thermal transfer ribbon of Example 1 was repeated except that a coating liquid 1 for a color layer was changed to a coating liquid 4 for a color layer having the following composition, thereby to prepare a thermal transfer ribbon of Comparative Example 2.

<Coating Liquid 4 for Color Layer>

Carbon black #44 (DBP oil absorption 78, BET specific surface area 115, available from Mitsubishi Kagaku Co., Ltd.): 30 parts Ethylene-vinyl acetate copolymer #250 (VA=19%, MI=15, available from Mitsui-Du Pont Polychemical Industries, Inc.): 45 parts Candelilla wax: 17.5 parts Petroleum resin (Neo-polymer 160, available from Nihon Sekiyu Kagaku Co., Ltd.): 7.5 parts Toluene: 285 parts Methyl ethyl ketone: 15 parts Comparative Example 3

The procedure for obtaining the thermal transfer ribbon of Example 1 was repeated except that a coating liquid 1 for a color layer was changed to a coating liquid 5 for a color layer having the following composition, thereby to prepare a thermal transfer ribbon of Comparative Example 3.

<Coating Liquid 5 for Color Layer>

Carbon black (DBP oil absorption 46, BET specific surface area 45, Printex25, available from West Germany Degsa Industries, Inc.): 28.5 parts Ketchen Black EC600JD (DBP oil absorption 495, BET specific surface area 1270, available from Ketchen Black Industries, Inc.): 1.5 parts Ethylene-vinyl acetate copolymer #250 (VA=19%, MI=15, available from Mitsui-Du Pont Polychemical Industries, Inc.): 45 parts Candelilla wax: 17.5 parts Petroleum resin (Neo-polymer 160, available from Nihon Sekiyu Kagaku Co., Ltd.): 7.5 parts Toluene: 285 parts Methyl ethyl ketone: 15 parts Comparative Example 4

The procedure for obtaining the thermal transfer ribbon of Example 1 was repeated except that a coating liquid 1 for a color layer was changed to a coating liquid 6 for a color layer having the following composition, thereby to prepare a thermal transfer ribbon of Comparative Example 4.

<Coating Liquid 6 for Color Layer>

Carbon black (DBP oil absorption 200, BET specific surface area 300): 21 parts

Ketchen Black EC600JD (DBP oil absorption 495, BET specific surface area 1270, available from Ketchen Black Industries, Inc.): 9 parts Ethylene-vinyl acetate copolymer #250 (VA=19%, MI=15, available from Mitsui-Du Pont Polychemical Industries, Inc.): 45 parts Candelilla wax: 17.5 parts Petroleum resin (Neo-polymer 160, available from Nihon Sekiyu Kagaku Co., Ltd.): 7.5 parts Toluene: 285 parts Methyl ethyl ketone: 15 parts Comparative Example 5

The procedure for obtaining the thermal transfer ribbon of Example 1 was repeated except that a coating liquid 1 for a color layer was changed to a coating liquid 7 for a color layer having the following composition, thereby to prepare a thermal transfer ribbon of Comparative Example 5.

<Coating Liquid 7 for Color Layer>

Carbon black (DBP oil absorption 170, BET specific surface area 270, Conductex 975 ULTRA, available from Columbian Carbon Industries, Inc.): 28.5 parts Ketchen Black EC (DBP oil absorption 360, BET specific surface area 800, available from Ketchen Black Industries, Inc.): 1.5 parts Ethylene-vinyl acetate copolymer (VA=15%): 45 parts Candelilla wax: 17.5 parts Petroleum resin (Neo-polymer 160, available from Nihon Sekiyu Kagaku Co., Ltd.): 7.5 parts Toluene: 285 parts Methyl ethyl ketone: 15 parts Comparative Example 6

The procedure for obtaining the thermal transfer ribbon of Example 1 was repeated except that a coating liquid 1 for a color layer was changed to a coating liquid 8 for a color layer having the following composition, thereby to prepare a thermal transfer ribbon of Comparative Example 6.

<Coating Liquid 8 for Color Layer>

Carbon black (DBP oil absorption 200, BET specific surface area 300): 28.5 parts Ketchen Black EC (DBP oil absorption 360, BET specific surface area 800, available from Ketchen Black Industries, Inc.): 1.5 parts Ethylene-vinyl acetate copolymer (V5773W, VA=33%, MI =90, available from Mitsui-Du Pont Polychemical Industries, Inc.): 45 parts Candelilla wax: 17.5 parts Petroleum resin (Neo-polymer 160, available from Nihon Sekiyu Kagaku Co., Ltd.): 7.5 parts Toluene: 285 parts Methyl ethyl ketone: 15 parts Comparative Example 7

The procedure for obtaining the thermal transfer ribbon of Comparative Example 2 was repeated except that the organic solvent for a coating liquid for a color layer was changed to a water-base solvent to thereby prepare a thermal transfer ribbon of Comparative Example 7. That is, carbon black/water-dispersed liquid (#44, DBP oil absorption 78, BET specific surface area 115, available from Mitsubishi Kagaku Co., Ltd.), ethylene-vinyl acetate copolymer emulsion (#250, VA =19%, MI=15, available from Mitsui-Du Pont Polychemical Industries, Inc.), Candelilla wax emulsion and petroleum resin emulsion were used. Solid contents of the respective components were set to be equal to those of Comparative Example 2.

Using the above thermal transfer ribbons of Examples and Comparative Examples, an electrical conductivity of each the thermal transfer ribbon was evaluated under the following condition, and printing operation was performed under the same printing condition to provide printed matters. Then, printing sensitivity and anti-abrasion property of each the respective printed matter was evaluated under the following evaluation criteria.

<Printing Condition>

The printing operation was performed by means of a thermal transfer bar-code printer (B472, mfd. by Toshiba TEC Co., Ltd.) at a printing speed of 8 inch/sec. A cast coat paper was used as an image-receiving sheet. A bar-code test pattern was printed by using the thermal transfer ribbons of examples and Comparative Examples to prepare evaluation samples.

(Electrical Conductivity)

Surface electrical resistance of each the respective thermal transfer ribbon was measured by means of a resistivity measuring device (HIRESTA-IR MCP-HT260, mfd. by Dia Instruments Co., Ltd.). Further, each the thermal transfer ribbon was inspected whether there was any deficiency in handling the ribbon or not.

(Printing Sensitivity)

With respect to the printed matters obtained under the above conditions, an image quality was visually observed in a point of sharpness and whether there was a faint or not. The printing sensitivity was evaluated on the basis of the following evaluation criteria.

○: Sharpness is excellent and patchy or fainted letters were not observed;

Δ: Sharpness is almost good and patchy or fainted letters were slightly observed; and X: Sharpness is lack and a lot of patchy or fainted letters were observed.

(Anti-abrasion Property)

With respect to the printed matters obtained under the above conditions, a cloth impregnated with isopropyl alcohol (IPA) was applied and a reciprocal rubbing motion was made for five times by a finger so as to rub a printed surface. Thereafter, the rubbed surface was visually observed in a point whether there was any stain on non-printed portion (ground portion) or any fallout on the printed portion. As a result, the anti-abrasion property was evaluated. Evaluation criteria are as follows.

○: Fallout of printed portion was substantially not observed and the stain of the ground portion is not a level raising a problem in the practical use;

Δ: Fallout of printed portion was slightly observed and there exist a stain of the ground portion; and X: Fallout of printed portion was notable and a lot of stains of the ground portion were observed.

<Evaluation Results>

The evaluation results of Examples and Comparative Examples are shown in Table 1 and Table 2 hereunder.

TABLE 1

| Sample No. | Electrical Conductivity: (Value denotes a surface resistivity.) | Printing Sensitivity | Anti-abrasion Property |
|---|---|---|---|
| Example 1 | $10^6$ Ω/□,there was no entanglement of the ribbon, and no problem in handling the ribbon. | ○ | ○ |
| Example 2 | The same as above. | ○ | ○ |
| Example 3 | The same as above. | ○ | ○ |

TABLE 2

| Sample No. | Electrical Conductivity: (Value denotes a surface resistivity.) | Printing Sensitivity | Anti-abrasion Property |
|---|---|---|---|
| Comparative Example 1 | $10^{13}$ Ω/□,when ribbon was drawn out from a rolled state, static electricity caused to pose a problem in handling the ribbon. | ○ | ○ |
| Comparative Example 2 | The same as in Example 1 | Δ | Δ |
| Comparative Example 3 | The same as in Comparative Example 1. | ○, however, image density was low | ○ |
| Comparative Example 4 | When the coated liquid for color layer was formed into an ink, viscosity of the liquid was increased, so that a liquid capable of being coated could not be prepared, thus being impossible to evaluate all characteristics of a ribbon. | | |
| Comparative Example 5 | $10^6$ Ω/□,other characteristics were the same as those in Example 1. | ○ | Δ |
| Comparative Example 6 | $10^{11}$ Ω/□, when the ribbon was drawn out from a rolled state, static electricity caused to pose a slight problem in handling the ribbon. | ○ | ○ |
| Comparative Example 7 | $10^{11}$ Ω/□, there was no entanglement of the ribbon, and no problem in handling the ribbon. | ○ | X |

As described above, the thermal transfer ribbon of the present invention has a structure in which at least the color layer mainly contained the binder resin are provide on the substrate, wherein the content of the color material contained in the color layer is 10–25 wt %, and the color material is composed of, at least one first carbon black having a DBP oil absorption of 50–150 ml/100 g and BET specific surface area of 50–250 $m^2$/g; and at least one second carbon black having a DBP oil absorption of 350–500 ml/100 g and BET specific surface area of 800–1300 $m^2$/g.

The first carbon black is excellent in dispersibility in the solution, while the second carbon black can easily form a grain structure of the carbon black capable of providing a high electrical conductivity. In the present invention, these two kinds of the first and second carbon blacks are combined to reduce the total amount of carbon blacks, so that sufficient anti-static property can be obtained even if the total amount of the carbon black is relatively small. As a result, there can be obtained a thermal transfer ribbon excellent in uniformity of coated film and printing sensitivity or the like, and the thermal transfer ribbon can be applied to a high-speed printing type thermal transfer printer.

Further, when a ratio of a total weight of the first carbon black to a total weight of the second carbon black is set to an appropriate mixing ratio within a range of 95:5–80:20, the dispersibility of the carbon blacks is not lowered in the coating liquid for a color layer.

In addition, when ethylene-vinyl acetate copolymer (EVA) containing, as a polymerized unit, 19–28% of vinyl acetate (VA) component is used as a main binder, and the color layer is formed by a solvent coating method using an organic solvent into which the above EVA is dissolved and the carbon blacks with an appropriate mixing ratio are dispersed, a coated film having an improved uniformity can be obtained. As a result, there can be obtained a thermal transfer ribbon excellent in anti-static property, durability such as anti-abrasion property, alcohol resistance or the like, and having a good printing sensitivity and capable of forming an image with high quality.

As described above, in the thermal transfer ribbon of the present invention, the electrical conductivity can be imparted to the ribbon by a small amount of the carbon black to be contained in the color layer, so that the thermal transfer ribbon can be formed to have a high sensitivity. Since the anti-static layer is not required to be separately formed to the thermal transfer ribbon, the thermal transfer ribbon can be prepared with a low cost.

In addition, even if the color layer is formed from a homogeneous ink dispersed in a resin solution, the electrical conductivity can be secured, so that a printed matter having a high alcohol-resistance can be obtained in comparison with a case where the color layer is formed from a resin emulsion-dispersing liquid or the like.

What is claimed is:

1. A thermal transfer ribbon comprising:

a substrate; and a color layer disposed on the substrate, said color layer comprising a binder resin and a color material, wherein said color material comprises a first carbon black having a dibutyl phthalate (DBP) oil absorption of 50–150 ml/100 g and a BET specific surface area of 50–250 m2/g and a second carbon black having a DBP oil absorption of 350–500 ml/100 g and a BET specific surface area of 800–1300 $m^2/g$, and said color layer contains the first and second carbon blacks at a total amount of 10–25 wt %.

2. A thermal transfer ribbon according to claim 1, wherein said thermal transfer ribbon further comprises a peeling layer and said color layer is disposed on the substrate via said peeling layer.

3. A thermal transfer ribbon according to claim 2, wherein said peeling layer comprises a wax.

4. A thermal transfer ribbon according to claim 1, wherein a ratio (a:b) of a weight (a) of said first carbon black to a weight (b) of said second carbon black is set within a range of 95:5–80:20.

5. A thermal transfer ribbon according to claim 1, wherein said color layer is formed by a solvent coating method using a coating liquid into which said binder resin is dissolved and said color material is dispersed.

6. A thermal transfer ribbon according to claim 5, wherein an ethylene-vinyl acetate copolymer containing 19–28% of a vinyl acetate component is used as the binder resin of said color layer.

7. A thermal transfer ribbon according to claim 5, wherein said thermal transfer ribbon further comprises a peeling layer comprising a micro crystalline wax or carnauba wax and said color layer is disposed on the substrate via said peeling layer.

8. A thermal transfer ribbon according to claim 1, wherein an adhesive layer containing no pigment is disposed on an outermost surface of the color layer.

9. A method of manufacturing a thermal transfer ribbon comprising the steps of:

providing a substrate;

providing a coating liquid prepared by dissolving a binder resin and dispersing a color material into a solvent, in which said color material comprises a first carbon black having a dibutyl phthalate (DBP) oil absorption of 50–150 ml/100 g and a BET specific surface area of 50–250 $m^2/g$ and a second carbon black having a DBP oil absorption of 350–500 ml/100 g and a BET specific surface area of 800–1300 $m^2/g$ and said coating liquid contains the first and second carbon blacks at a total amount of 10–25 wt % in terms of solid content; and coating said coating liquid to the substrate so as to form a color layer.

10. A method of manufacturing a thermal transfer ribbon according to claim 9, wherein said substrate is provided with a peeling layer and said color layer is formed on the substrate via said peeling layer.

11. A method of manufacturing a thermal transfer ribbon according to claim 10, wherein said peeling layer comprises a micro crystalline wax or carnauba wax.

12. A method of manufacturing a thermal transfer ribbon according to claim 9, wherein a ratio (a:b) of a weight (a) of said first carbon black to a weight (b) of said second carbon black in the coating liquid is set within a range of 95:5–80:20.

13. A method of manufacturing a thermal transfer ribbon according to claim 9, wherein an ethylene-vinyl acetate copolymer containing 19–28% of a vinyl acetate component is used as the binder resin of the color layer.

14. A method of manufacturing a thermal transfer ribbon according to claim 9, wherein an adhesive layer containing no pigment is further formed on an outermost surface of said color layer.

* * * * *